United States Patent [19]

Smith

[11] 4,042,111

[45] Aug. 16, 1977

[54] CONTAINER FOR BULK MATERIAL

[75] Inventor: Rush B. Smith, Philadelphia, Pa.

[73] Assignee: Pennsylvania Pacific Corporation, Warminster, Pa.

[21] Appl. No.: 640,004

[22] Filed: Dec. 12, 1975

[51] Int. Cl.[2] ..... B65D 21/02

[52] U.S. Cl. ..... 206/508; 206/511

[58] Field of Search ..... 206/508, 509, 511, 519

[56] References Cited

U.S. PATENT DOCUMENTS

| | | | |
|---|---|---|---|
| 2,761,582 | 9/1956 | Moore | 206/508 |
| 3,376,046 | 4/1968 | Kivett | 206/508 |
| 3,539,552 | 10/1970 | Mounts | 206/519 |
| 3,759,416 | 9/1973 | Constantine | 206/508 |
| D. 201,398 | 6/1965 | Burns | D87/1 R |

*Primary Examiner*—George E. Lowrance

*Attorney, Agent, or Firm*—Smith, Harding, Earley & Follmer

[57] ABSTRACT

A nestable plastic container for handling and storage of bulk material such as food products is provided with three parallel, laterally spaced, downwardly extending hollow ridges forming supporting members. These ridges permit the use of a fork lift to handle the container. The ridges are hollow and open to the interior of the container but they may be easily cleaned by reason of the fact that they extend substantially the full length of the bottom of the container, and also by reason of the fact that they have a trapezoidal cross-section for easy access to their interiors. Specially designed ridges on the cover of the container receive one of the downwardly extending ridges of another container securing it against lateral motion, and thereby permitting safe stacking of multiple containers.

2 Claims, 7 Drawing Figures

CONTAINER FOR BULK MATERIAL

BACKGROUND OF THE INVENTION

This invention relates to containers for bulk materials, and particularly to large containers of the kind used for handling and storage of food and chemical products. In the food processing industry, products such as poultry, meat and fruit are handled, stored and shipped in containers having capacities ranging from approximately 50 to 250 gallons of liquid. These containers are made of various materials, including paperboard, galvanized steel, stainless steel, and plastic. Usually, the containers are open-topped vessels, having a bottom and four upwardly extending sides, and being closable at the top by a separate cover. They are used not only by food processors, but also in agriculture, and in the pharmaceutical, chemical and petro-chemical industries for handling and storing a wide range of products.

The containers are large in size, and the term "large" as used herein will be understood to refer to a size of a container such that, when filled with a product, cannot be easily carried manually by a single person. Normally, fork lifts or pallet jacks are used to transport these large containers. Unless the container itself is provided with openings for the insertion of fork lift or pallet jack tines, a separate pallet is required. Tanks can be provided with legs or openings to accommodate lifting mechanisms. Constructing such legs or openings adds much to the complexity and cost of paperboard and steel containers. In the case of plastic containers, legs suitable to accommodate fork lift tines can be readily provided in the process of molding the container without greatly increasing the cost of the container. However, unless the legs are solid, their interiors will form a number of narrow pockets open to the interior of the main body of the container. Such pockets are objectionable especially in food processing, because they tend to collect food particles, and are difficult to clean. Solid legs, on the other hand, are more difficult to mold, and not only waste plastic, but add to the weight of the container without materially improving its strength.

SUMMARY OF THE INVENTION

The principal object of this invention is to provide a container for the handling and storage of large quantities of bulk material comprising a unitary molded plastic liquid-tight tub, which is transportable by means of a fork lift or pallet jack without the use of a separate pallet, which is easily cleanable, and which utilizes a minimum amount of plastic in its construction. In order to accomplish the foregoing object the container in accordance with this invention comprises a unitary molded plastic liquid-tight tub having a bottom and four upwardly extending sides, there being integrally molded in said bottom, three parallel, laterally spaced, downwardly extending, hollow ridges forming supporting members for the container, said ridges extending substantially the full length of the bottom of said tub, and establishing between adjacent pairs of ridges, spaces for the entry of the tines of a fork lift or pallet jack.

Another object is to permit the safe stacking of multiple containers when filled. In order to accomplish this object, a cover is provided with an integrally molded ridge adapted to surround the middle one of the downwardly extending ridges of a next container resting on the cover. This integrally molded ridge on the cover safely secures the container resting on the cover against lateral movement and rotation.

Other objects, advantageous features and advantages of the invention will be apparent from the following detailed description, when read in conjunction with the drawings.

DETAILED DESCRIPTION

The container of FIGS. 1–4 comprises a unitary molded plastic liquid-tight tub having a bottom 8, and four upwardly extending sides 10, 12, 14 and 16. The term "plastic" is used herein in its most common sense, and refers to synthetic resins which are moldable into various forms and hardened for commercial use. Polyethylene and polystyrene are typical examples of plastics as used herein. The term is intended to include reinforced plastics, and plastics containing various fillers or other materials intended to alter their characteristics.

Figure 1:
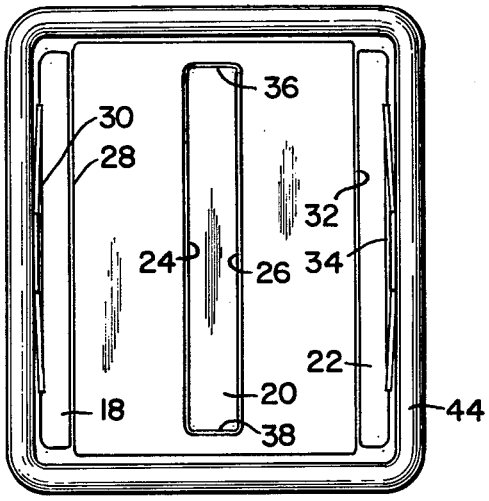
FIG. 1 is a top plan view of a container in accordance with a first embodiment of the invention.
Figure 2:
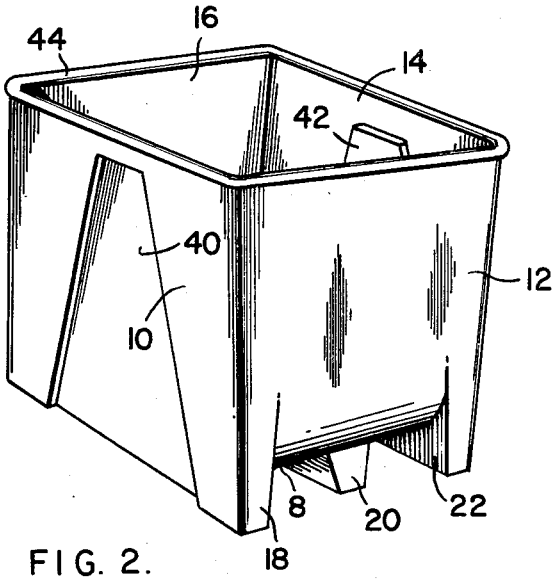
FIG. 2 is a perspective view of the container of FIG. 1.
Figure 3:
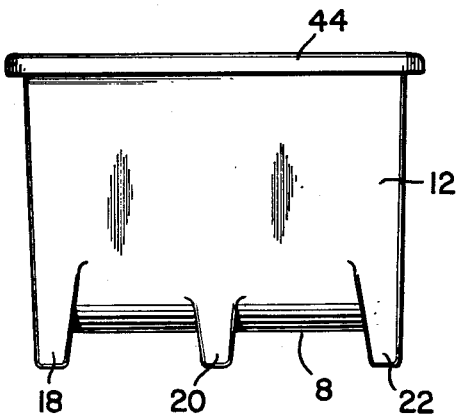
FIG. 3 is a side elevation of the container of FIG. 1, as viewed from the bottom of FIG. 1.
Figure 4:
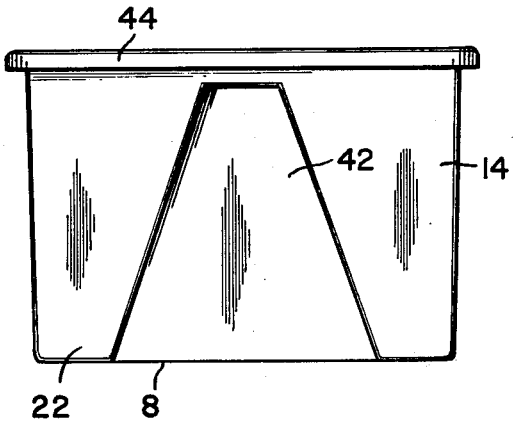
FIG. 4 is an elevation of the container of FIG. 1, as viewed from the right-hand side thereof.

In the bottom of the tub, there are mounted three parallel, laterally spaced, downwardly extending, hollow ridges 18, 20 and 22. The bottoms of these ridges are coplanar, as seen in FIG. 3 so that all three ridges can lie simultaneously on a flat floor, and form supporting members for the container. Although ridge 20 is slightly shorter than ridges 18 and 22, all three ridges extend substantially the full length of the bottom of the tub. Because of their lengths, the insides of the ridges are much more easily cleaned than the narrow pockets which would be formed in hollow legs. Brushes and other cleaning devices can be readily used for cleaning the interiors of ridges 18, 20 and 22, because the length of the ridges makes their interiors much more easily accessible.

Adjacent pairs of ridges establish between them spaces for the entry of the tines of a fork lift or a pallet jack. These tines can enter in either of two directions, that is either toward the left, or toward the right of the container as viewed in FIG. 4.

Preferably, the ridges are trapezoidal, that is the opposite lengthwise inner walls are sloped in directions such that the bottom of the inside of each ridge is narrower than the opening thereof into the interior of the main body of the container. Thus, for example, the opposite lengthwise inner walls 24 and 26 of ridge 20 (FIG. 1) are sloped so that the bottom of ridge 20 is smaller than the opening thereof into the interior of the main body of the container. The lengthwise opposite walls 28 and 30 of ridge 18 and 32 and 34 of ridge 22 are similarly sloped. The sloping of these lengthwise walls provides better access to the interiors of the ridges for cleaning purposes. The widthwise walls of the ridges, e.g., walls 36 and 38 of ridge 20 are also sloped for the same reason. However, the sloping of these widthwise walls is less important than the sloping of the lengthwise walls.

The upwardly extending side walls 10, 12, 14 and 16 are typically one-quarter inch in thickness where polyethylene, the preferred material, is used. Preferably, all four walls slope slightly outwardly from bottom to top, so that a number of containers may be nested together when they are not in use. The slope of these walls must be such that, from bottom to top, they extend outwardly by a distance greater than the wall thickness of the sides.

The containers may be molded with depressions 40 and 42 in the outer walls of sides 10 and 14 respectively. These depressions are for ornamental purposes. The container is also desirably provided with an integrally molded lip 44 along the upper edges of the side walls. A removable cover fits over lip 44 to provide a complete closure of the container.

Figure 5:
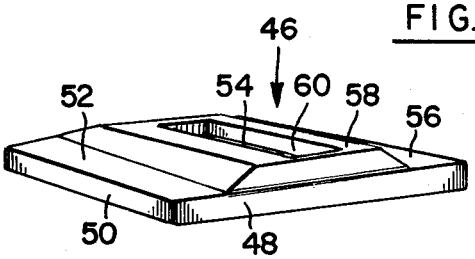
FIG. 5 is a perspective view of a cover for use in conjunction with the container of FIGS. 1–4.

Referring now to FIG. 5, the cover 46 is a unitary piece of molded plastic adapted to rest on lip 44, which constitutes the upper edges of the four upwardly extending sides 10, 12, 14 and 16 of the tub. Desirably, cover 46 is provided with four downwardly extending sides, including sides 48 and 50, to form a skirt adapted to fit tightly over lip 44 to provide a secure closure, and prevent the cover from moving laterally with respect to the tub. Three elongated, parallel, substantially coplanar surfaces 52, 54 and 56 are provided on the upper side of the cover. These surfaces are adapted to support the parallel, laterally spaced, downwardly extending hollow ridges of another container resting thereon so that similar containers, either empty or filled, can be stacked, one upon the other. In order to secure stacked containers safely against lateral movement and rotation, the middle one of the three coplanar surfaces, that is surface 54, is surrounded by a ridge 58, integrally molded into the cover. The inner wall 60 of ridge 58 conforms to the shape of ridge 20 of the container. Ridge 58 is thus adapted to secure a container resting on surfaces 52, 54 and 56 against lateral motion and rotation.

The ridge 58 preferably surrounds the central one of the three coplanar surfaces on the upper side of the cover. However, the ridge could be positioned around any one of the three coplanar surfaces, or a combination thereof. The surrounding of the central one of the three surfaces is preferred, as the long sides of ridge 58 can be made wider, and therefore stronger, and because the short sides of ridge 58 can likewise be made wider and stronger by virtue of the slightly shorter length of the central downwardly extending ridge on the bottom of the tub.

The ridge 58 need not be continuous, but an element thereof must exist on each of the four sides of surface 54 in order to secure the container resting on the surfaces of the cover against translation. In the event ridge 58 is discontinuous, it is also preferable that the parts of the long sides thereof which are present be sufficiently long or in sufficient number to secure the cover and the container resting thereon against relative rotation.

Figure 6:
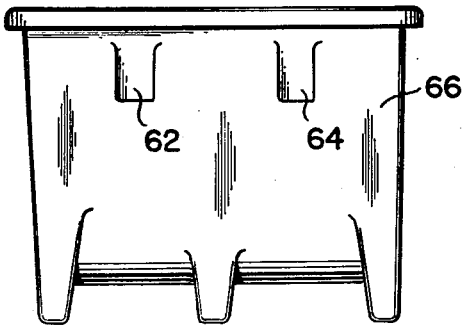
FIG. 6 is a side elevation of an alternative embodiment of the invention, having projections adapted to engage the upper edges of corresponding sides of the next lower container in a nest of containers.
Figure 7:
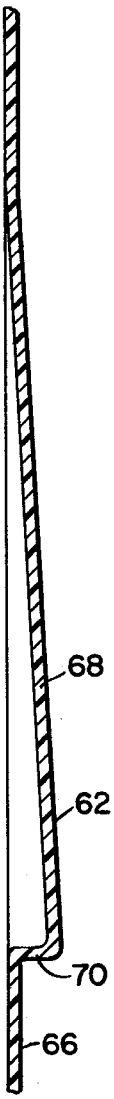
FIG. 7 is a vertical section of a projection of the type shown in FIG. 6.

Ridge 58 need not be high, as a fraction of an inch above coplanar surfaces 52, 54 and 56 is sufficient to insure that the proper relationship between stacked containers will be maintained. The ridge is desirably as short as possible in order not to interfere with the tines of a fork lift, or pallet jack, used to stack containers.

Where the containers are nestable, and particularly where the downwardly extending ridges are trapezoidal, so that they fit into each other in nesting, the nested containers are particularly difficult to separate. In order to prevent the downwardly extending ridges from fitting into each other, special projections are provided in the side walls of the container, as illustrated in FIGS. 6 and 7. Two outward projections 62 and 64 are provided in side 66, and two similar projections (not shown) are provided in the side opposite side 66. The projections are molded into the side walls of the container in the manufacturing process. As shown in FIG. 7, projection 62 comprises a gradually sloping portion 68, terminating in a horizontal ledge 70, the underside of which is adapted to engage the lip of a container corresponding to lip 44. Ledge 70, and the corresponding ledges of the remaining projections are preferably so positioned as to prevent the outsides of the downwardly extending ridges of a container from fitting tightly into the insides of the downwardly extending ridges of the next lower container, into which the first-mentioned container is nested.

Where these projections are used, the slopes of the container walls may be made very nearly vertical, yet the containers can be nested far into each other for conservation of storage space.

I claim:

1. A container for the handling and storage of large quantities of bulk material comprising a unitary molded plastic liquid-tight tub having a bottom and four upwardly extending sides; a lip along the upper edges of the sidewalls; three parallel, laterally spaced, downwardly extending, hollow ridges forming supporting members for the container being integrally molded in said bottom; said ridges extending substantially the full length of the bottom of said tub, and establishing, between adjacent pairs of ridges, spaces for the entry of the tines of a forklift or pallet jack; removable cover means adapted to rest on the upper edges of said four upwardly extending sides and to enclose said tub; said cover means also being composed of molded plastic; said cover means having means for engaging the sides of the tub and preventing lateral movement of the cover with respect to the tub comprising four downwardly extending sides forming a skirt adapted to fit tightly over the lip along the upper edges of the tub sidewalls; said cover means also having means providing three elongated, parallel substantially coplanar surfaces on the upper side thereof; said cover surfaces being adapted to support parallel, laterally spaced, downwardly extending hollow ridges of another container resting thereon; at least one of said three elongated, parallel cover surfaces being surrounded by ridge means integrally molded into said cover; said ridge means extending upwardly from said cover surfaces; said ridge means conforming to the shape of a ridge of the container and being adapted thereby to surround said container ridge and to secure said container resting on said cover surfaces against lateral motion.

2. A container according to claim 1 in which at least two opposite sides are provided with outward projections adapted to engage the upper edges of corresponding sides of the next lower container in a nest of containers.

* * * * *